US005677677A

United States Patent [19]

Duff et al.

[11] Patent Number: 5,677,677

[45] Date of Patent: Oct. 14, 1997

[54] SYSTEM FOR MONITORING THE OPERATION OF AN EVAPORATOR UNIT

[75] Inventors: Paul J. Duff, Lebanon; John P. Larson, Burlington, both of Conn.; Joseph B. Lechtanski, Castle Rock, Colo.

[73] Assignee: Carrier Corporation, Syracuse, N.Y.

[21] Appl. No.: 426,810

[22] Filed: Apr. 21, 1995

[51] Int. Cl.[6] ..... G08B 21/00

[52] U.S. Cl. ..... 340/585; 62/125; 62/129; 165/11.1; 340/584; 340/606; 340/675

[58] Field of Search ..... 340/585, 584, 340/606, 675; 62/125, 129; 165/11.1

[56] References Cited

U.S. PATENT DOCUMENTS 5,009,076 4/1991 Winslow ..... 62/129

5,152,152 10/1992 Brickner et al. ..... 62/129

5,351,500 10/1994 Morrow ..... 62/129

5,457,965 10/1995 Blair et al. ..... 62/129

*Primary Examiner*—Glen Swann

[57] ABSTRACT

The difference between the temperature of a heat exchange medium leaving the evaporator unit of a chiller and the temperature of the refrigerant in the evaporator unit is monitored relative to a real time alarm limit for this temperature difference. The real time alarm limit is computed from time to time by a microprocessor. The value of the computed alarm limit will vary with the cooling load being experienced by the chiller's evaporator unit.

12 Claims, 2 Drawing Sheets

SYSTEM FOR MONITORING THE OPERATION OF AN EVAPORATOR UNIT

BACKGROUND OF THE INVENTION

This invention relates to monitoring the operation of a component within a chiller system. In particular, this invention relates to monitoring the evaporator or cooling unit of a chiller system.

The evaporating or cooling units within certain chiller systems operate on a "flooded cooler" basis. This means that the heat exchange medium to be cooled will flow through a conduit or tubing immersed in liquid refrigerant within the evaporating or cooling unit. Heat flows from the heat exchange medium through the tube walls into the refrigerant which then evaporates. When the liquid refrigerant level in the evaporator or cooling unit drops or becomes too low, the tubing will no longer be fully immersed in liquid refrigerant. This will produce a less efficient heat extraction by the evaporator or cooling unit. Such inefficient heat extraction may go unnoticed when the chiller system is responding to relatively low cooling demands. This same inefficient heat extraction will however become quite noticeable during the peak cooling season. It is precisely at this time of year that one can least afford to shutdown the chiller system for repair or servicing.

In order to avoid the above need for servicing, it has heretofore been the practice to manually check the refrigerant level of the cooling or evaporator unit from time to time. Any such manual checking will only be a verification that the refrigerant level is acceptable at that point in time. Any subsequent drop in refrigerant level will go undetected until the next manual check is performed.

OBJECTS OF THE INVENTION

It is an object of the invention to provide an alarm system for a chiller which automatically detects abnormal drops in refrigerant level within the evaporating or cooling unit when these drops first occur.

It is another object of the invention to detect any appreciable change in the heat transfer capabilities of an evaporating or cooling unit regardless of the time of year.

SUMMARY OF THE INVENTION

The above and other objects are achieved by providing a system which monitors the difference in temperature of the heat exchange medium leaving the evaporating unit and the temperature of the refrigerant residing in the evaporating unit. The system applies an alarm limit to this temperature difference. The alarm limit that is applied will vary with the cooling load experienced by the chiller system and will rise as the cooling load increases. In accordance with the invention, the cooling load being experienced by the system is first computed. The alarm limit for this computed cooling load is thereafter computed in accordance with a predefined functional relationship between alarm limit and cooling load. An alarm is generated when the difference in temperature between the heat exchange medium and the temperature of the refrigerant in the evaporator unit exceeds this computed limit.

The predefined functional relationship of alarm limit versus cooling load is preferably linear for a substantial range of cooling loads. The slope of this linear relationship is determined by noting the difference in temperature of the heat exchange medium leaving the evaporating unit and temperature of the refrigerant in the unit at two different cooling load conditions. For instance, the difference in sensed temperatures at a high cooling load condition and a low cooling load condition can be used to define the slope of a straight line between these two data points. Any further deviation that is deemed permissible above the line drawn through the data points can be added as a constant to the data points so as to arrive at a linearly varying alarm limit for an appreciable range of cooling load conditions.

BRIEF DESCRIPTION OF THE DRAWINGS

Other objects and advantages of the present invention will be apparent from the following description in conjunction with the accompanying drawings in which:

FIG. 1 illustrates a chiller system having a refrigerant loop including a condenser unit and an evaporator unit for removing heat from the water passing there through;

FIG. 4 illustrates a temperature monitoring process executable by the alarm monitor of FIG. 2 which includes the alarm limit determined in FIG. 3; and FIG. 5 illustrates a routine executable by the alarm monitor of FIG. 2 in conjunction with the temperature monitoring process of FIG. 4.

DESCRIPTION OF THE PREFERRED EMBODIMENT

Figure 1:
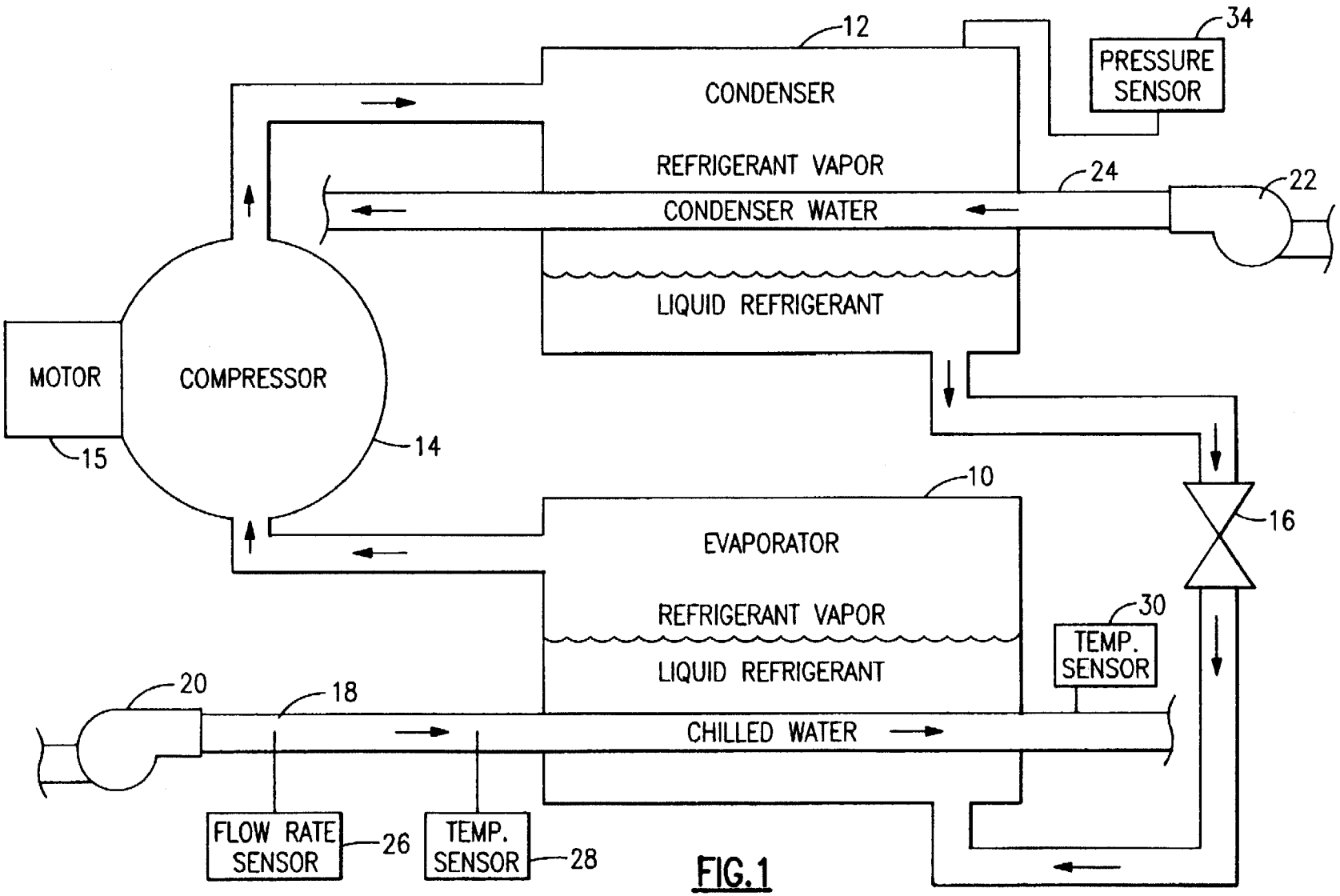

Referring to FIG. 1, a chiller system is seen to include an evaporator unit 10, a condenser unit 12, and a compressor unit 14. The compressor unit 14 includes a motor 15 associated therewith. The motor 15 when activated will cause the compressor unit to compress entering refrigerant vapor from the evaporator unit 10. Refrigerant leaving the compressor unit will enter the condenser unit 12 before passing through a flow control metering device 16 to the evaporator unit 10. The liquid refrigerant in the evaporator unit 10 chills water being pumped through a conduit 18 via a chilled water pump 20. The chilled water in the conduit 18 exits the evaporator unit 10 for circulation through appropriate cooling devices in for instance an office building before returning to the evaporator unit for further chilling.

It is also to be noted that condenser water is pumped by a pump 22 through tubing 24 running through the condenser unit 12. The condenser water removes the heat of compression from the refrigerant in the condenser unit 12. The condenser water exiting from the condenser unit 12 is circulated through a cooling tower (not shown) before returning to the pump 22.

Referring again to the pumped water passing through the evaporator unit 10, the flow rate of this water is detected by a flow rate sensor 26. The temperature of this pumped water flowing into the evaporator unit 10 is sensed by a temperature sensor 28. The temperature of the water flowing out of the evaporator unit 10 is sensed by a temperature sensor 30. As will be explained in detail hereinafter, these sensed values will be used to calculate the cooling load being imposed on the evaporator unit at any particular point in time.

The temperature of the liquid refrigerant in the evaporator unit is also sensed by a sensor 32. The difference between this sensed temperature and the temperature of the water leaving the evaporating unit as sensed by sensor 30 will be monitored by the alarm monitoring system of FIG. 2. This temperature difference will hereinafter be referred to as the evaporator leaving temperature difference.

Figure 2:
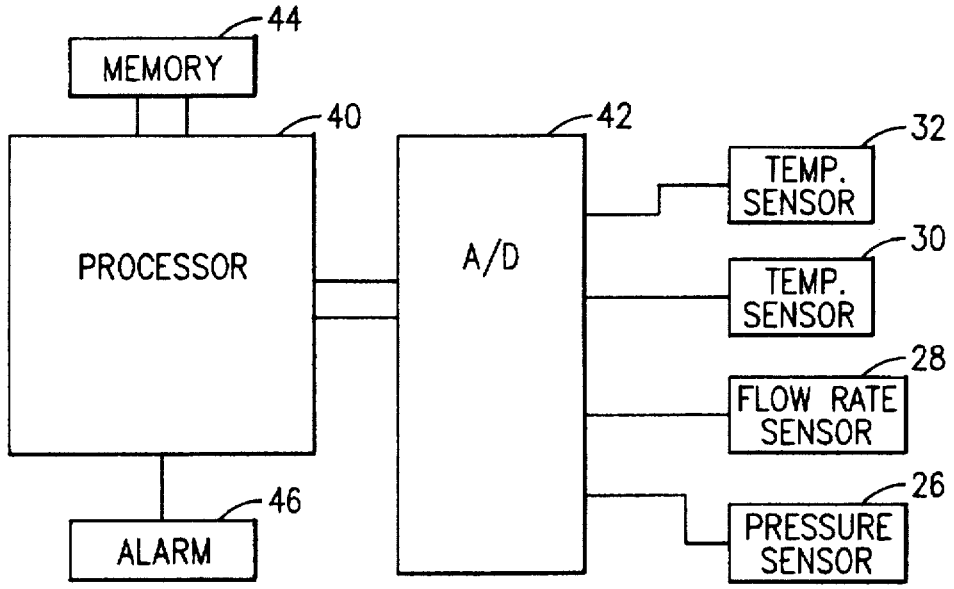
FIG. 2 illustrates an alarm monitor for monitoring the difference between the temperature of the water leaving the evaporating unit and the temperature of the refrigerant in the evaporating unit.

Referring to FIG. 2, the alarm monitoring system responsive to the evaporator leaving temperature difference is illustrated. The alarm monitor system is seen to include a microprocessor 40 receiving digital signals from an A/D converter circuit 42. The analog to digital converter circuit 42 digitizes analog signals from the sensors 26, 28, 30 and 32. As will be explained in detail hereinafter, the microprocessor 40 computes a cooling load based on the digitized values read from the sensors 26, 28 and 30. The microprocessor thereafter computes an alarm limit for the evaporator leaving temperature difference based on the computed cooling load. The actual evaporator leaving temperature difference as sensed by sensors 30 and 32 is compared with this computed alarm limit. The microprocessor generates a signal to an alarm 46 when the actual evaporator leaving temperature difference exceeds the computed alarm limit.

Figure 3:
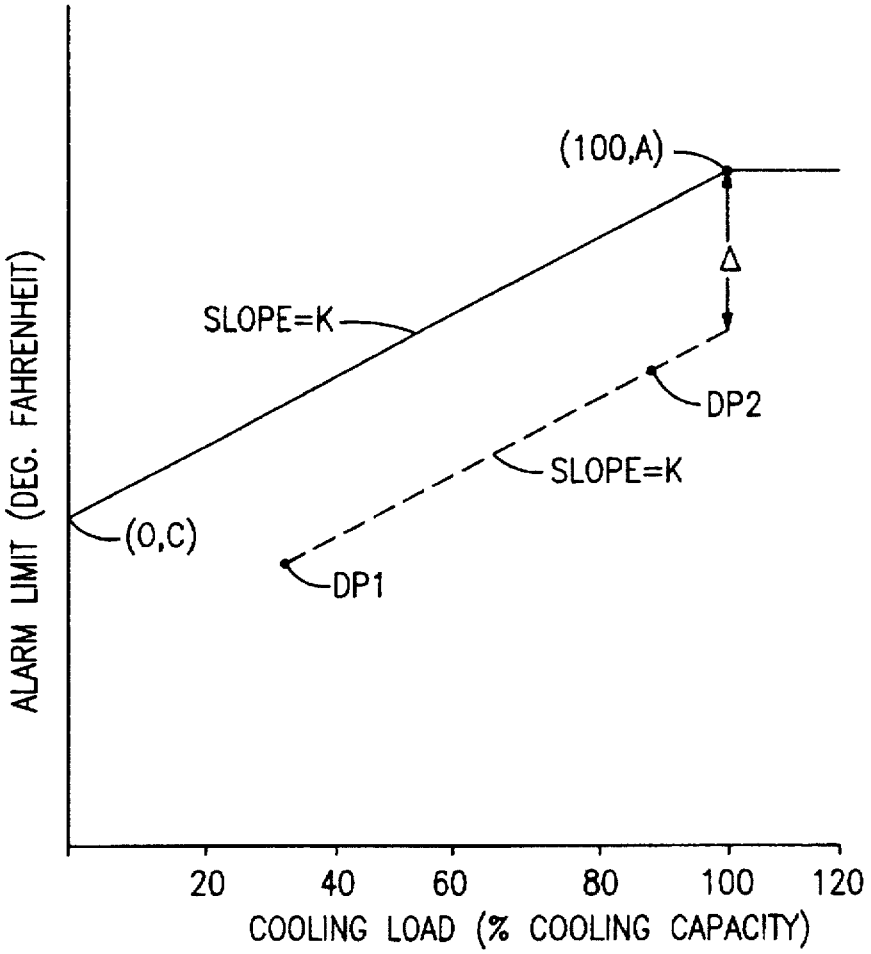
FIG. 3 is a graphical depiction of how the alarm limit for the difference between the temperature of the water leaving the evaporating unit and the temperature of the refrigerant in the evaporating unit is determined.

Referring to FIG. 3, the functional relationship of alarm limit to computed cooling load that is preferably used by the microprocessor 40 to compute the alarm limit is illustrated. The alarm limit is expressed in terms of temperature difference in degrees Fahrenheit. The computed cooling load on the evaporator unit 10 is expressed in terms of a percentage of the rated cooling capacity of the chiller system. This computed cooling load is derived by first calculating the cooling load in refrigeration tons on the evaporator unit 10 as follows:

$$LOAD=CWFR*(ECWT-LCWT)/(24\ gpm\text{-}deg\ F./Ton)$$

where CWFR=chilled water flow rate in gallons per minute sensed by sensor 26;

where ECWT=entering chilled water temperature in degrees Fahrenheit sensed by sensor 28;

where LCWT=leaving chilled water temperature in degrees Fahrenheit sensed by sensor 30; and where the constant, 24 gpm-deg F./Ton, is derived from the definition of a refrigeration ton, the number of minutes in an hour, the specific gravity of water, and the specific heat of water as follows:

$$(12{,}000\ BTU/hour/Ton)/(60\ minute/hour)*(8.33\ lbs/gallon)*(1\ BTU/lb\text{-}deg\ F.))=24\ gpm\text{-}deg\ F./Ton$$

The resulting calculated cooling load in refrigeration tons is divided by the design cooling capacity rating for the chiller system expressed in refrigeration tons. It is to be understood that design cooling capacity ratings are well known in the art and are generally available for chiller systems.

Referring again to FIG. 3, it is noted that the alarm limit is seen to vary linearly with the computed cooling loads on the evaporator unit 10 for computed cooling loads up to one hundred percent of the design cooling capacity rating. This linear relationship is seen to have a slope "K" and an intercept "C" with respect to the alarm limit axis.

The slope "K" and the intercept "C" may be derived by first obtaining two sets of temperature readings from the sensors 30 and 32 for two different cooling load conditions on the evaporator unit 10. The difference between the leaving water temperature sensed by sensor 30 and the refrigerant temperature sensed by sensor 32 is calculated for each set of readings. For purposes of illustration, these two leaving temperature differences for the two different cooling load conditions appear as data points DP1 and DP2 in FIG. 3. These two data points can be used to define a dotted line linear relationship in FIG. 3 of evaporator leaving temperature difference expressed in degrees Fahrenheit versus cooling load on the evaporator unit expressed in percentage system cooling capacity. The slope of this dotted line will be the slope "K" of the alarm limit. As noted in FIG. 3, the alarm limit is spaced at an increment of Δ above the dotted line through the data points DP1 and DP2. The increment, Δ, is preferably the difference between maximum allowable evaporator leaving temperature difference, "A", at one hundred percent design cooling capacity and the value of evaporator leaving temperature difference that would occur at this cooling load condition according to the dotted line through the data points DP1 and DP2. Stated differently, the alarm limit value, "A", at one hundred percent design cooling capacity should preferably be no more than the evaporator leaving temperature difference that would be allowed at one hundred percent cooling capacity during the peak cooling season. This upper limit is usually well known for a given chiller system. It is to be noted that the alarm limit of FIG. 3 may not exceed this upper limit for percentage cooling loads in excess of one hundred percent of design cooling capacity. It is to be appreciated that the intercept point "C" on the alarm limit axis can be defined once the slope, "K", and the upper permissible alarm limit value, "A", at one hundred percent of design cooling capacity are known. It is also to be appreciated that the intercept point, "C", will reflect inclusion of the Δ increment as do all values of alarm limit for percentage cooling loads of less than one hundred percent.

Referring now to FIG. 4, the alarm limit program executed by the microprocessor 40 is illustrated in detail. The program begins with a step 48 wherein the microprocessor 40 reads the design cooling capacity rating for the chiller system that has been stored in the memory 44 as CAPACITY. The microprocessor proceeds in a step 49 to read the values for the constants "A", "K" and "C" from the memory 44. The microprocessor now proceeds to a step 50 wherein a suitable delay is introduced before proceeding further in the alarm limit program. It is to be appreciated that the delay may be used by the microprocessor 40 to execute any number of other control programs before returning to the particular alarm monitor program. Following the timing out of the delay in step 50, the microprocessor proceeds to a step 51 and executes a MTR_FLAG routine. As will be explained in detail hereinafter, the MTR_FLAG routine sets a MTR_FLAG only if the motor 15 for the compressor unit 14 has been running for a predetermined period of time. The predetermined period of time must be sufficient to assure that the chiller system has reached a steady state operating condition following activation of the motor 15. The microprocessor will proceed from the MTR_FLAG routine to step 52 and inquire as to whether the MTR_FLAG has been set. If the MTR_FLAG is not set, the microprocessor will return to step 50 and again execute the delay required by this step. Referring again to step 52, if the MTR_FLAG is set, the microprocessor will proceed to read digitized sensor values for chilled water flow rate, CWFR, entering chilled water temperature, ECWT, and leaving chilled water temperature, LCWT, in a step 54. It is to be understood that the chilled water flow rate value, CWFR, is originally produced by the flow rate sensor 26 and is digitized in a manner well known in the art by the A/D circuit 42. In a similar fashion, ECWT originates at the sensor 28 and LCWT originates at sensor 30. The microprocessor proceeds in a step 56 to compute the cooling load on the evaporator unit 10 in refrigeration tons. The microprocessor next proceeds in a step 58 to compute what percentage of CAPACITY is represented by the computed cooling load of step 56. The microprocessor next inquires in a step 60 as to whether the percentage cooling load computed in step 58 is greater than one hundred percent. If the percentage cooling load is greater than one hundred percent, the microprocessor will set the alarm limit equal to "A" in step 62. If the percentage cooling load is less than or equal to one hundred percent, the microprocessor will compute the alarm limit in a step 64. Referring to step 64, the alarm limit is computed by multiplying the resultant cooling load expressed in terms of percentage of CAPACITY from step 58 by the constant K and adding the constant C thereto. This alarm limit computation is in accordance with the linear functional relationship set forth in FIG. 3. The microprocessor next proceeds in a step 66 to read the digitized sensor value of the evaporator liquid refrigerant temperature, ERT. LCWT has been provided from sensor 30 via the A/D circuit 42 in step 54 whereas ERT is provided from sensor 32 via the A/D circuit. The evaporator leaving temperature difference, ELTD, is thereafter computed in step 68 as the difference between LCWT and ERT. The thus computed ELTD is compared with the calculated alarm limit resulting from either step 62 or step 64 in a step 70. In the event that the alarm limit is exceeded, the microprocessor proceeds to a step 72 and sets the alarm 46. If the ELTD is less than the alarm limit, the microprocessor proceeds out of step 70 to a step 73 and clears the alarm 46. The alarm 46 may be either a display which displays a warning or an audible alarm on a control panel for the chiller system. The microprocessor next returns to step 50 wherein the delay is again introduced before proceeding to the MTR_FLAG routine. It is to be appreciated that the alarm limit program of FIG. 4 will continuously calculate the alarm limit based on the particular percentage cooling load of design cooling capacity being experienced by the evaporator unit 10. In this manner, the alarm limit will consistently be adjusted for any cooling load being experienced at the evaporator unit 10 that is less than one hundred percent of design cooling capacity. An alarm will be generated when the alarm limit is exceeded.

Referring to FIG. 5, the MTR_FLAG routine is illustrated. This routine begins with a step 74 which inquires as to whether the motor 15 is on. It is to be appreciated that the motor 15 will usually be activated by a control process separately executed by the microprocessor 40. Any such active "on" command from the control process will be duly noted in step 74. If the motor is on, the microprocessor will proceed to a step 76 and inquire as to whether a MTR_TIMER is on. The MTR_TIMER will initially be off if the motor 15 has just been activated by the control process. The microprocessor will hence proceed from step 76 to step 78 and inquire as to whether the MTR_FLAG is on. The MTR_FLAG will be initially off prompting the microprocessor to proceed to a step 80 and start the MTR_TIMER. The microprocessor will exit the MTR_FLAG routine and inquire in step 52 as to whether the MTR_FLAG has been set. Since the MTR_FLAG is not set, the microprocessor will proceed back to step 50. Following the delay instituted in step 50, the microprocessor will return to the MTR_FLAG routine and again inquire as to whether the motor 15 is on. Assuming the motor 15 continues to be on, the microprocessor will proceed to note the MTR_TIMER is on in step 76 prompting an inquiry in step 82 as to whether the MTR_TIMER is greater than a predetermined time, "T". The time "T" will define the amount of time that the chiller system must take to reach a steady state operating level following activation of the motor 15. Until the MTR_TIMER equals or exceeds this time, the microprocessor will simply exit from the MTR_FLAG routine without setting the MTR_FLAG. When MTR_TIMER does however exceed the predetermined time, "T", the microprocessor will proceed to step 84 and set the MTR_FLAG. The microprocessor will thereafter reset the MTR_TIMER in step 86 before exiting the MTR_FLAG routine. It is to be appreciated that the microprocessor will proceed to note that the MTR_FLAG has been set in step 52, prompting execution of the alarm monitoring steps of FIG. 4. The alarm monitoring will continue to occur until such time as the MTR_FLAG routine notes in step 74 that the motor 15 is no longer on prompting the microprocessor to set the MTR_FLAG to an off status in step 88.

It is to be appreciated that a particular embodiment of the invention has been described. Alterations, modifications and improvements thereto may readily occur to those skilled in the art. For instance, a nonlinear alarm limit could also be used in the above disclosed alarm limit program. An evaporator unit exhibiting such a nonlinear behavior could be appropriately tested with a curve being generated from the data. Any permissible increment of evaporator leaving temperature difference could be added to the generated curve. The appropriate mathematical expression for the nonlinear curve could be generated for use by the alarm monitor program. Accordingly the foregoing description is by way of example only and the invention is to be limited only by the following claims and equivalents thereto.

What is claimed is:

1. A system for monitoring the difference in temperature of a heat exchange medium leaving an evaporator unit of a chiller and the temperature of a refrigerant within the evaporator unit of the chiller, said system comprising:

a sensor for sensing the temperature of the heat exchange medium leaving the evaporator unit;

a sensor for sensing the temperature of the refrigerant in the evaporator unit;

means for computing an evaporator leaving temperature difference based upon the sensed temperature of the heat exchange medium leaving the evaporator unit and the temperature of the refrigerant in the evaporator unit;

means for computing a real time alarm limit for the evaporator leaving temperature difference based upon a real time cooling load condition being experienced by the chiller;

means for comparing the computed evaporator leaving temperature difference with the computed real time alarm limit for the evaporator leaving temperature difference; and means for generating a wanting when the computed evaporator leaving temperature difference exceeds the computed real time alarm limit.

2. The system of claim 1 wherein said means for computing a real time alarm limit for the evaporator leaving temperature difference comprises:

means for sensing the flow rate of the heat exchange medium passing through the evaporator unit;

means for sensing the temperature of the heat exchange medium entering the evaporator unit;

means for sensing the temperature of the heat exchange medium leaving the evaporator unit;

means for computing a cooling load on the evaporator unit as a function of the flowrate of the heat exchange medium, temperature of the heat exchange medium entering the evaporator unit, and the temperature of the heat exchange medium leaving the evaporator unit; and means for computing an alarm limit value for evaporator leaving temperature difference as a function of the computed cooling load on the evaporator unit.

3. The system of claim 2 wherein said means for computing an alarm limit for evaporator leaving temperature difference using the computed cooling load on the evaporator unit comprises:

means for multiplying the computed cooling load by a first constant and adding a second constant to the resulting product wherein a portion of the second constant includes a permitted variance from the evaporator leaving temperature difference normally occurring at the computed cooling load.

4. The system of claim 3 wherein said means for computing an alarm limit for evaporator leaving temperature difference using the computed cooling load on the evaporator unit comprises:

means for dividing the computed cooling load on the evaporator unit by a cooling capacity rating for the chiller so as to generate a ratio of computed cooling load to rated cooling capacity of the chiller; and means for multiplying the ratio of computed cooling load to rated cooling capacity by a first constant and adding a second constant to the resulting product wherein a portion of the second constant includes a permitted variance from the evaporator leaving temperature difference normally occurring at the computed cooling load.

5. The system of claim 2 wherein said means for computing an alarm limit for evaporator leaving temperature difference as a function of the computed cooling load on the evaporator unit comprises:

means for dividing the computed cooling load on the evaporator unit by a cooling capacity rating for the chiller so as to generate a ratio of computed cooling load to rated cooling capacity of the chiller;

means for determining whether the ratio of computed cooling load to rated cooling capacity is greater than a predetermined numerical value;

means for setting the alarm limit equal to a maximum allowable evaporator leaving temperature difference when the ratio of computed cooling load to rated cooling capacity is greater than the predetermined numerical value; and means for computing an alarm limit for evaporator leaving temperature difference as a function of the ratio of computed cooling load to rated cooling capacity of the chiller when the ratio of computed cooling load to rated cooling capacity is less than the predetermined numerical value.

6. The system of claim 5 wherein said means for computing an alarm limit for evaporator leaving temperature difference comprises:

means for multiplying the ratio of computed cooling load to rated cooling capacity by a first constant and adding a second constant to the resulting product wherein a portion of said second constant includes a permitted variance from the normal evaporator leaving temperature difference normally occurring at the computed cooling load.

7. A process for monitoring the difference in the temperature of a heat exchange medium leaving an evaporator unit of a chiller and the temperature of a refrigerant within the evaporator unit of the chiller, said process comprising the steps of:

sensing the temperature of the heat exchange medium leaving the evaporator unit;

sensing the temperature of the refrigerant in the evaporator unit;

computing an evaporator leaving temperature difference based upon the sensed temperature of the heat exchange medium leaving the evaporator unit and the temperature of the refrigerant in the evaporator unit;

computing a real time alarm limit for the evaporator leaving temperature difference based upon a real time cooling load condition being experienced by the chiller;

comparing the computed evaporator leaving temperature difference with the computed real time alarm limit for the evaporator leaving temperature difference; and generating a warning when the computed evaporator leaving temperature difference exceeds the computed real time alarm limit.

8. The process of claim 7 wherein said step of computing a real time alarm limit for the evaporator leaving temperature difference comprises the steps of:

sensing the flow rate of the heat exchange medium passing through the evaporator unit;

sensing the temperature of the heat exchange medium entering the evaporator unit;

sensing the temperature of the heat exchange medium leaving the evaporator unit;

computing a cooling load on the evaporator unit as a function of the flowrate of the heat exchange medium, temperature of the heat exchange medium entering the evaporator unit, and the temperature of the heat exchange medium leaving the evaporator unit; and computing an alarm limit value for evaporator leaving temperature difference using the computed cooling load on the evaporator unit.

9. The process of claim 8 wherein said step of computing an alarm limit for evaporator leaving temperature difference using the computed cooling load on the evaporator unit comprises the step of:

multiplying the computed cooling load by a first constant and adding a second constant to the resulting product wherein a portion of the second constant includes a permitted variance from the evaporator leaving temperature difference normally occurring at the computed cooling load.

10. The process of claim 9 wherein said step of computing an alarm limit for evaporator leaving temperature difference using the computed cooling load on the evaporator unit comprises the steps of:

dividing the computed cooling load on the evaporator unit by a cooling capacity rating for the chiller so as to generate a ratio of computed cooling load to rated cooling capacity of the chiller; and multiplying the ratio of computed cooling load to rated cooling capacity by a first constant and adding a second constant to the resulting product wherein a portion of the second constant includes a permitted variance from the evaporator leaving temperature difference normally occurring at the computed cooling load.

11. The process of claim 8 wherein said step of computing an alarm limit for evaporator leaving temperature difference using the computed cooling load on the evaporator unit comprises the steps of:

dividing the computed cooling load on the evaporator unit by a cooling capacity rating for the chiller so as to generate a ratio of computed cooling load to rated cooling capacity of the chiller;

determining whether the ratio of computed cooling load to rated cooling capacity is greater than a predetermined numerical value;

setting the alarm limit equal to a maximum allowable evaporator leaving temperature difference when the ratio of computed cooling load to rated cooling capacity is greater than the predetermined numerical value; and computing an alarm limit for evaporator leaving temperature difference as a function of the ratio of computed cooling load to rated cooling capacity of the chiller when the ratio of computed cooling load to rated cooling capacity is less than the predetermined numerical value.

12. The process of claim 11 wherein said step of computing an alarm limit for evaporator leaving temperature difference comprises the steps of:

multiplying the ratio of computed cooling load to rated cooling capacity by a first constant and adding a second constant to the resulting product wherein a portion of said second constant includes a permitted variance from the evaporator leaving temperature difference normally occurring at the computed cooling load.

* * * * *